US006784125B1

(12) United States Patent
Yamakawa et al.

(10) Patent No.: US 6,784,125 B1
(45) Date of Patent: Aug. 31, 2004

(54) NONWOVEN THERMOPLASTIC ELASTOMER FABRIC ROLL AND METHOD AND APPARATUS FOR MAKING SAME

(75) Inventors: Yukio Yamakawa, Hofu (JP); Tadashi Furuya, Hofu (JP); Tsutomu Teshima, Hofu (JP); Yutaka Tanaka, Osaka (JP)

(73) Assignees: Kanebo, Ltd., Tokyo (JP); Kanebo Gohsen, Ltd., Osaka (JP)

( * ) Notice: Subject to any disclaimer, the term of this patent is extended or adjusted under 35 U.S.C. 154(b) by 155 days.

(21) Appl. No.: 09/595,241

(22) Filed: Jun. 16, 2000

(30) Foreign Application Priority Data

Mar. 7, 2000 (JP) ..... 2000-062755

(51) Int. Cl.[7] ..... D04H 1/00; D04H 13/00; D04H 3/00; B32B 5/12

(52) U.S. Cl. ..... 442/328; 442/327; 442/329; 442/361; 428/113

(58) Field of Search ..... 442/327, 361, 442/328, 329; 428/113

(56) References Cited

U.S. PATENT DOCUMENTS 3,439,085 A 4/1969 Hartmann et al. ..... 264/210
4,910,064 A * 3/1990 Sabee ..... 428/113
5,814,569 A * 9/1998 Suzuki et al. ..... 442/328

FOREIGN PATENT DOCUMENTS

JP 06-253493 5/1996 ..... D04H/3/00

* cited by examiner

*Primary Examiner*—Cheryl A. Juska
*Assistant Examiner*—Lynda Salvatore
(74) *Attorney, Agent, or Firm*—Morgan & Finnegan, LLP

(57) ABSTRACT

The invention provides a thermoplastic elastomer nonwoven fabric roll that exhibits minimal longitudinal wrinkles and minimal delayed restoration when unrolled, and method and apparatus for producing the same. Thermoplastic elastomer filaments that have been melt-spun are piled on a belt conveyor thereby forming a sheet of nonwoven fabric, that is guided to a rotating roller disposed above the transportation zone of the belt conveyor and peeled off therefrom. Since minimal tension is applied to the nonwoven fabric during processing, the nonwoven fabric can be unrolled with little stretching by applying relatively little tension to the nonwoven fabric. By the method of this invention, a nonwoven fabric roll with unrolling tension of 0.25 g/cm/basis-weight or less can be formed.

1 Claim, 6 Drawing Sheets

Prior Art

NONWOVEN THERMOPLASTIC ELASTOMER FABRIC ROLL AND METHOD AND APPARATUS FOR MAKING SAME

FIELD OF THE INVENTION

The present invention relates to nonwoven fabric rolls, made by winding up onto a tube a nonwoven fabric formed from thermoplastic elastomer filaments, and methods and apparatus for producing nonwoven fabric rolls.

BACKGROUND

Nonwoven fabrics are commonly produced by spinning a thermoplastic resin into fibers, and allowing the freshly spun fibers to pile on a moving conveyor belt. Entangled filaments bond with each other due to the high self-adhesive properties of the still-hot thermoplastic elastomer, thereby forming a sheet of nonwoven fabric. The sheet is typically compressed in some manner to produce the desired thickness and density. The nonwoven fabric, formed into a sheet, is then transported by the belt conveyor toward nip rollers which peel the fabric from the belt conveyor. Then the nonwoven fabric is wound up by a take-up device around a cylindrical core to form a nonwoven fabric roll.

Since the freshly spun thermoplastic elastomer has highly adhesive properties, the spun filaments tend to adhere to the belt conveyor as well as to one another. As a result, it is necessary to apply a significant amount of tension to the nonwoven fabric to peel it from the belt conveyor.

Consequently, when the nip rollers peel the nonwoven fabric from the belt conveyor, a tension due to the adhesion acts on the nonwoven fabric causing the fabric to stretch, while shrinking in the direction of width, with the formation of longitudinal wrinkles. In prior art apparatus and methods, because the nip rollers are disposed downstream of the nonwoven fabric, the tension $T_a$ acting on the nonwoven fabric being peeled off is significantly greater than the force F required for peeling off, as shown in FIG. 11. Thus the nonwoven fabric production apparatus of the prior art has problems in that a very large tension is exerted on the nonwoven fabric when peeling it off the belt conveyor, resulting in wrinkles formed along the length of the nonwoven fabric. The longitudinal wrinkles are then fixed on the nonwoven fabric as the wrinkled fabric is pressed between the nip rollers.

Also, because the tension caused by the nip rollers acts between the nip rollers and the take-up device as well, the nonwoven fabric is tightly wound up around the tube while under tension. The nonwoven fabric roll wound by the take-up device is used in the production of many products, such as first aid bandages or gloves, by punching the nonwoven fabric after unrolling it from the roll. Since the nonwoven fabric roll is wound tightly, a nonwoven fabric roll that has been left for a long period of time becomes difficult to unroll, partly due to the self-adhesive properties of the thermoplastic elastomer. As a result, there has also been a problem in that significant tension must be applied to unroll the nonwoven fabric, which causes an elastic deformation wherein the nonwoven fabric stretches lengthwise and shrinks in the direction of width. This deformation is spontaneously reversed after a period of time (delayed restoration), after the punch forming process, thus causing a change in the punched shape.

There is a need for nonwoven fabric rolls which do not exhibit longitudinal wrinkles, and which may be unwound with little or no deformation so that delayed restoration does not lead to a change in shape of derived products. There is also a need for methods and apparatus for producing nonwoven fabric rolls having such properties.

BRIEF DESCRIPTION OF THE INVENTION

It is an object of the present invention to provide a thermoplastic elastomer nonwoven fabric roll exhibiting reduced wrinkles and reduced change in shape associated with delayed restoration. It is a further object of the invention to provide a method and apparatus for producing such a roll.

The invention relates to a nonwoven fabric roll formed by winding a nonwoven fabric, formed from thermoplastic elastomer filaments accumulated and bonded into a sheet, around a tube, wherein the nonwoven fabric roll is formed so that the tension (unrolling tension) exerted on the nonwoven fabric when being unrolled from the nonwoven fabric roll is not greater than 0.25 g/cm/basis-weight.

When the unrolling tension exceeds 0.25 g/cl/basis-weight, it becomes necessary to apply an excessive tension to the nonwoven fabric when unrolling the nonwoven fabric roll. This causes the nonwoven fabric to experience such an elastic deformation as stretching in the direction of length and shrinking in the direction of width and, when the nonwoven fabric is punched to form a product, the punched shape changes due to delayed restoration of the elastic deformation, thus making it impossible to produce good products. When strictly taking the change in shape due to delayed restoration into consideration, the unrolling tension is preferably 0.20 g/cm/basis-weight or less, and more preferably 0.15 g/cm/basis-weight or less.

According to this invention, the filaments that are spun from the spinning device are piled up and bonded to form a sheet of nonwoven fabric on the belt conveyor. The nonwoven fabric thus formed is carried by the belt conveyor and peeled from the belt conveyor by a rotating roller disposed above the transportation zone, to be wound by the take-up device around the tube to make the nonwoven fabric roll.

As mentioned previously, since the thermoplastic elastomer has highly adhesive property, the filaments that are spun therefrom tend to adhere to the belt conveyor. As a result, it is necessary to apply a significant amount of tension to the nonwoven fabric to peel off the nonwoven fabric from the belt conveyor. According to this invention, since the nonwoven fabric is peeled from the belt conveyor by the lifting action of the rotating roller disposed above the transportation zone of the belt conveyor, substantially the same tension as exerted on the nonwoven fabric is applied to peel off the nonwoven fabric. As a consequence, the nonwoven fabric can be peeled from the belt conveyor by applying only the minimum tension that is necessary and sufficient, thus making it possible to minimize the elastic deformation and longitudinal wrinkling of the nonwoven fabric that are caused when peeling off.

Since the tension is reduced as described above, the tension acting on the nonwoven fabric between the rotating roller and the take-up device is also reduced, so that the nonwoven fabric is wound up into a roll with a lower tension. As a result, the nonwoven fabric roll thus formed is wound less tightly. Thus even under the influence of the adhesive property that is characteristic to the thermoplastic elastomer, the nonwoven fabric roll that can be easily unrolled with an unrolling tension of 0.25 g/cm/basis-weight or less can be formed. Such a nonwoven fabric roll having favorable unrolling performance requires a relatively lower tension to unroll the nonwoven fabric, and makes it possible to minimize the change in the punched shape due to delayed restoration.

Figure 1:
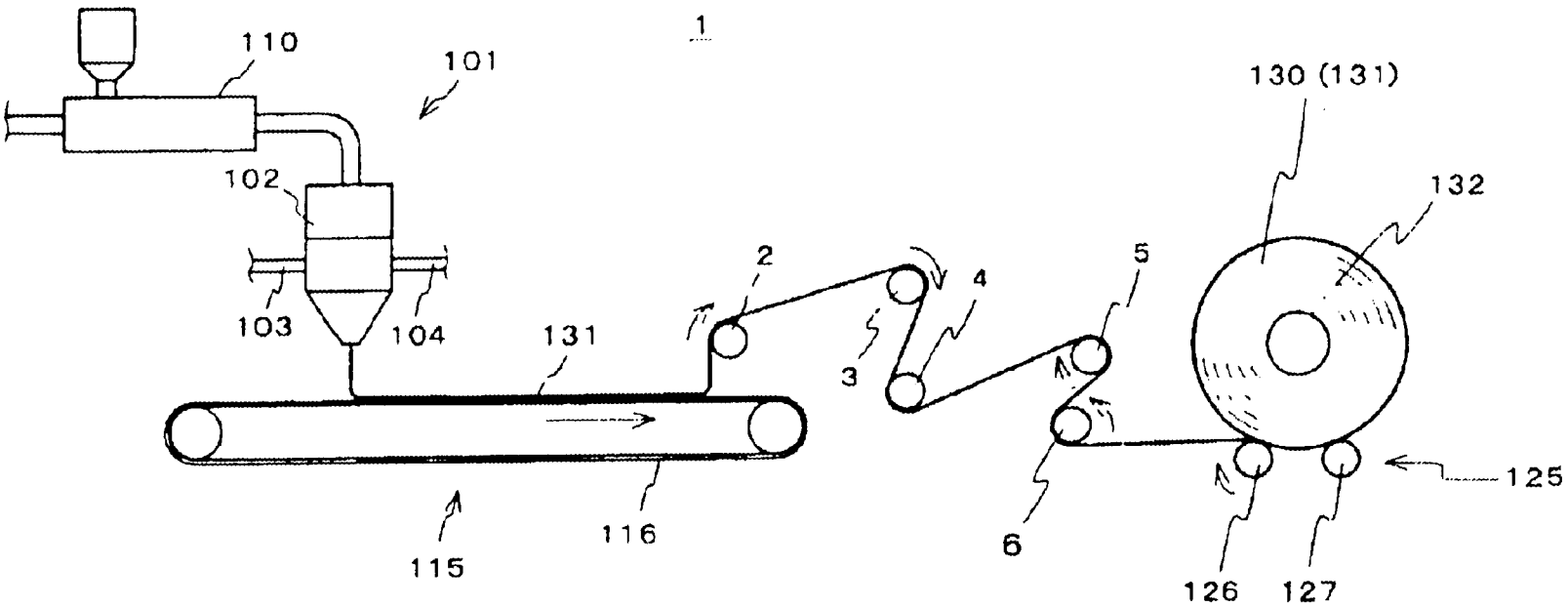
FIG. 1 is a front view schematically showing the constitution of a thermoplastic elastomer nonwoven fabric roll production apparatus according to one embodiment of the present invention.
Figure 2:
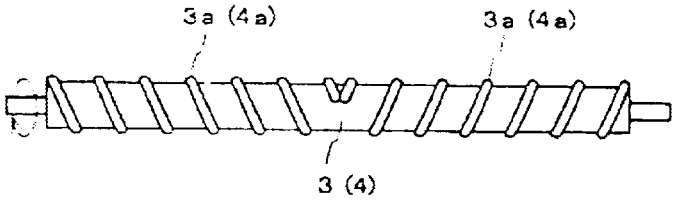
FIG. 2 is a front view showing a width expanding roller of this embodiment.

| Description of Reference Numerals |
|---|
| 1: Nonwoven fabric roll production apparatus |
| 2: Rotating roller |
| 3, 4: Width expanding roller |
| 5, 6: Feed roller |
| 101: Spinning device |
| 102: Melt blow head |
| 110: Melt extruder |
| 115: Belt conveyor |
| 125: Take-up device |
| 130: Nonwoven fabric roll |
| 131: Nonwoven fabric |

DETAILED DESCRIPTION OF THE INVENTION

Figure 9:
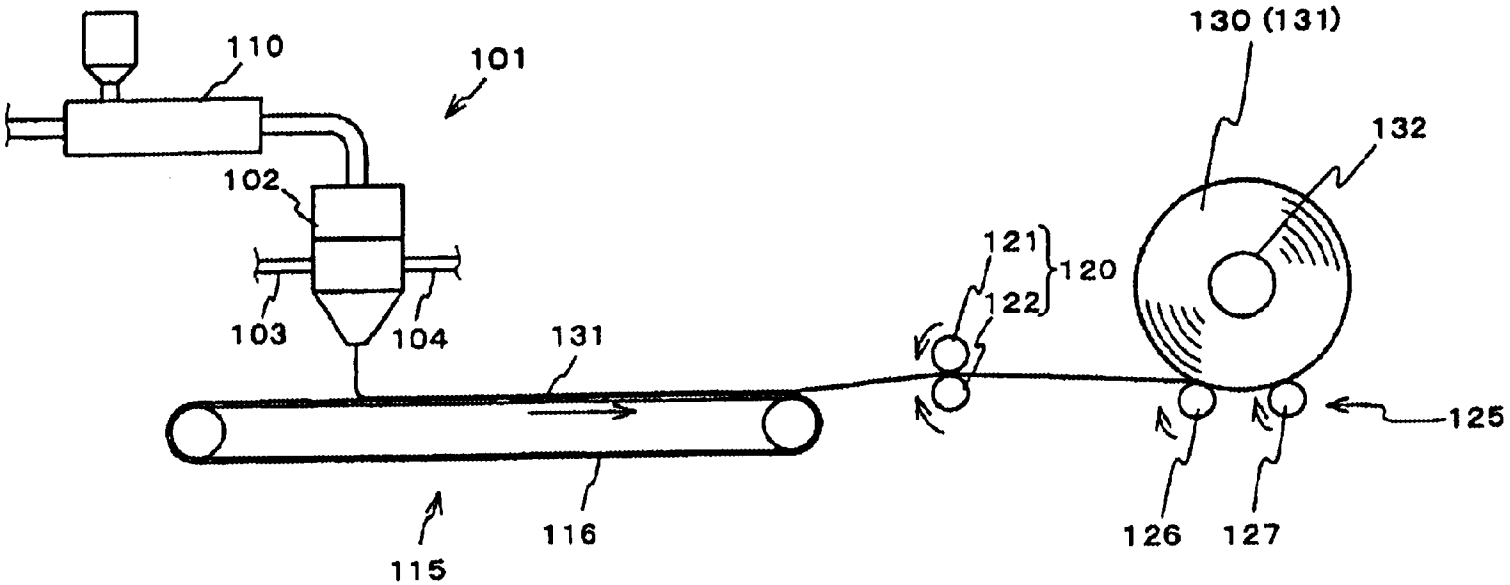
FIG. 9 is a front view schematically showing the constitution of a thermoplastic elastomer nonwoven fabric roll production apparatus of the prior art.

An example of prior art apparatus for producing a thermoplastic elastomer nonwoven fabric roll is shown in FIG. 9. As shown in the drawing, the nonwoven fabric roll production apparatus 100 comprises a spinning device 101, that has a melt extruder 110 for melting dried thermoplastic elastomer chips and discharging the melt and a melt blow head 102 for discharging the thermoplastic elastomer from nozzles and spinning filaments, thereby spinning the filaments by the so-called melt blow process, a belt conveyor 115 that is disposed below the melt blow head 102 and transports the filaments being spun by the melt blow head 102 while piling the filaments into a sheet of nonwoven fabric 131 thereon, nip rollers 120 that take up the nonwoven fabric 131 from the belt conveyor 115, and a take-up device 125 that winds the nonwoven fabric 131 fed from the nip rollers 120 around a tube 132 thereby forming a nonwoven fabric roll 130.

Figure 10:
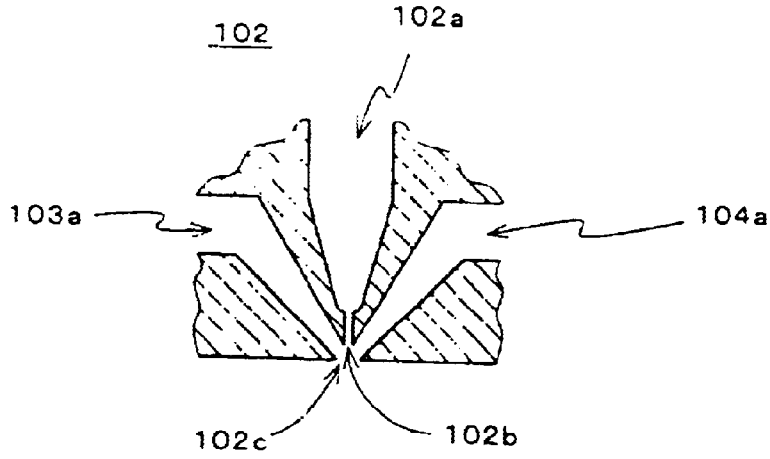
FIG. 10 is a sectional view of a nozzle portion of a melt blow head.

As shown in FIG. 10, the melt blow head 102 has a discharge port 102*c* that is formed in the shape of a slit and is disposed on the bottom surface thereof, and nozzles 102*b* formed at equal intervals above the discharge port 102*c* and facing thereto, while the discharge port 102*c* and the nozzles 102*b* are disposed along the width of the belt conveyor 115. Formed before and after the nozzles 102*b* in the transport direction of the belt conveyor 115 are gas supply passages 103*a* and 104*a*, so that a heated and compressed gas is supplied from the gas supply passages 103*a* and 104*a* to the discharge port 102*c* and discharged from the discharge port 102*c*. The nozzles 102*b* receive a constant amount of molten thermoplastic elastomer supplied through a passage 102*a* that communicates thereto. The gas supply passages 103*a* and 104*a* receive the heated and compressed gas from gas supply means (not shown) through supply pipes 103 and 104, respectively, as shown in FIG. 9.

A conveyor belt 116 that constitutes the belt conveyor 115 is an endless belt made of wire mesh having a predetermined mesh size, and runs in the direction indicated by arrow thereby to transport the nonwoven fabric 131 placed thereon in this direction. The nip rollers 120, comprising a pair of rollers 121, 122 that are pressed against each other, are disposed to be in parallel to each other in the vertical direction, and rotate in the direction indicated by arrow thereby to pull the nonwoven fabric 131 carried on the belt conveyor 115 off the belt conveyor 115 and feed the nonwoven fabric 131 toward the take-up device 125. The take-up device 125 is provided with a pair of take-up rollers 126, 127 disposed in a horizontal plane at a predetermined distance. At least one of the take-up rollers 126, 127 serves as a drive roller that rotates in the direction indicated by arrow thereby to rotate the tube 132, that is placed on the take-up rollers 126, 127, about the axis of rotation thereof and wind up the nonwoven fabric 131 around the tube 132, thereby forming the nonwoven fabric roll 130.

In the nonwoven fabric roll production apparatus 100 having the constitution described above, first the molten thermoplastic elastomer is supplied from the melt extruder 110 to the melt blow head 102, and is continuously discharged from the nozzles 102. The gas supply passages 103*a* and 104*a* of the melt blow head 102 receive the heated and compressed gas from the gas supply means (not shown) through the supply pipes 103 and 104, respectively, with the gas being spouted from the discharge port 102*c* at a predetermined flow velocity. Thus the thermoplastic elastomer discharged from the nozzles 102*b* is carried by an air stream spouted from the discharge port 102*c* and is formed into extremely thin filaments.

The filaments that have been spun as described above flow down right below to gather on the conveyor belt 116 of the belt conveyor 115 while the filaments are entangled with those nearby. Entangled filaments bond with each other due to the high self-adhesion properties of the thermoplastic elastomer thereby forming a sheet of nonwoven fabric 131. The nonwoven fabric 131 formed in a sheet is transported through the transportation zone of the belt conveyor 115 toward the nip rollers 120 and is peeled from the belt conveyor 115 by the nip rollers 120. Then the nonwoven fabric 131 is wound up by the take-up device 125 around the tube 132 to form the nonwoven fabric roll 130.

At a normal temperature, the thermoplastic elastomer has properties similar to those of vulcanized rubber, and shows high stretchability, high frictional resistance and adhesive property, as well as the high self-adhesion property described above. As a result, the filaments piled on the conveyor belt 116 bond not only with each other but also with the conveyor belt 116.

Figure 11:
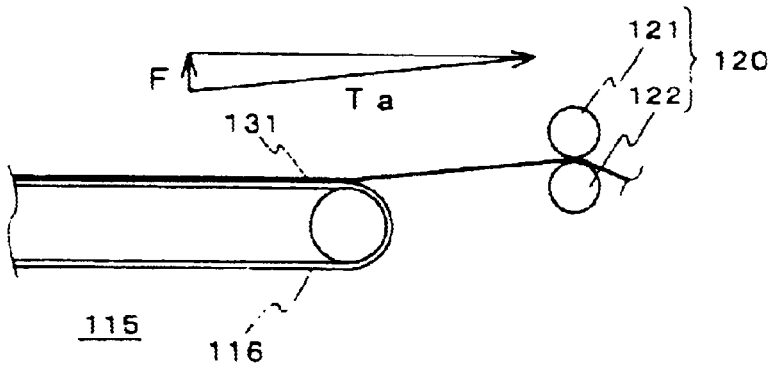
FIG. 11 is a view showing the action of nip rollers in the prior art.

Consequently, when the nip rollers 120 peel the nonwoven fabric 131 from the belt conveyor 115, a tension due to the adhesion acts on the nonwoven fabric 131 thus causing the nonwoven fabric 131 to stretch while shrinking in the direction of width, with the formation of longitudinal wrinkles. Also because the nip rollers 120 are disposed downstream of the nonwoven fabric 131 in the transporting direction beyond the belt conveyor 115 in the nonwoven fabric roll production apparatus 100, tension Ta acting on the nonwoven fabric 131 being peeled off is significantly greater than the force F required for peeling off, as shown in FIG. 11. Thus the nonwoven fabric production apparatus 100 of the prior art has problems due to the large tension exerted on the nonwoven fabric 131 when peeling the nonwoven fabric 131 from the belt conveyor 115 resulting in wrinkles formed along the length of the nonwoven fabric 131. The longitudinal wrinkles are then fixed on the nonwoven fabric 131 as the wrinkled nonwoven fabric 131 is pressed by the nip rollers 120.

Also, because the tension caused by the nip rollers 120 acts between the nip rollers 120 and the take-up device 125 as well, the nonwoven fabric 131 is wound up around the tube 132 while under tension. The nonwoven fabric roll 130 wound by the take-up device 125 is used in the production of, for example, first aid bandages or gloves by punching the nonwoven fabric 131 after unrolling the nonwoven fabric roll 130. However, since the nonwoven fabric roll 130 is wound very tightly due to the tension, a nonwoven fabric roll that has been left for a long period of time becomes difficult to unroll partly due to the self-adhesive properties of the thermoplastic elastomer. As a result, there has also been a problem in that a significant tension must be applied to unroll the nonwoven fabric roll 131 to extend the nonwoven fabric 131, which causes an elastic deformation wherein the nonwoven fabric 131 stretches lengthwise and shrinks in the direction of width. The deformation reverses itself later (delayed restoration) after the punch forming process, thus causing a change in the shape of the punched item.

The unrolling tension T in the present invention is given as follows, by denoting the tension actually acting on the nonwoven fabric as measured with a tension measuring instrument as t(g), width of the nonwoven fabric as 1 (cm) and basis weight of the nonwoven fabric as W (g/m$^2$).

$$T=(t/1)/W$$

The thermoplastic elastomer of the present invention may be materials such as known melt-spinnable polyurethane elastomers, polyester elastomers prepared by copolymerizing polybutylene terephthalate with various aliphatic polyols, polystyrene, polystyrene-based elastomers, and olefinic elastomers. Among these, the polyurethane elastomers have excellent mechanical properties such as tensile strength, rate of recovery after stretching and chemical resistance, and these are preferred thermoplastic elastomers. Polyurethane elastomers that have JIS Shore A scale hardness in a range from 75 to 98 are capable of making an elastomer that has excellent stretchability and mechanical properties, and are therefore preferable. When the Shore A scale hardness is 75 or lower, the tensile strength of the elastomer decreases and, when Shore A scale hardness is 98 or higher, the stretch restoration of the elastomer decreases. The polyurethane elastomer is preferably modified by adding thereto one or more additives such as phenolic antioxidants, light-resistant agents such as benzotriazole, salicylic acid and hindered amines, and adhesion inhibitors such as amide wax and montan wax.

The thermoplastic elastomer nonwoven fabric is preferably produced by the method of the present invention, and the method is preferably carried out by means of the apparatus of the present invention. The invention provides a method of producing a nonwoven fabric roll by piling thermoplastic elastomer filaments that have been melt-spun on a belt conveyor, thereby forming a sheet of nonwoven fabric, pulling off the nonwoven fabric thus formed from the belt conveyor and winding the nonwoven fabric around a tube to form a roll, wherein the nonwoven fabric carried on the belt conveyor is peeled from the belt conveyor and guided to a rotating roller disposed above the transportation zone of the belt conveyor so that the nonwoven fabric that has been peeled off is wound around the tube and formed into the roll. The invention also provides an apparatus for producing the nonwoven fabric roll, comprising a spinning device that has a nozzle head for discharging the molten thermoplastic elastomer formed nozzles and spinning filaments, a belt conveyor disposed below the nozzle head for transporting the filaments spun out of the nozzle head while piling up the filaments into a sheet of nonwoven fabric, a rotating roller for peeling off the nonwoven fabric formed the belt conveyor and a take-up device for winding up the nonwoven fabric, that is fed via a rotating roll, around the tube, with the rotating roller being disposed above the transportation zone of the belt conveyor.

As the distance between the position where the nonwoven fabric is peeled from the belt conveyor and the position where the rotating roller is located becomes larger, the nonwoven fabric becomes more likely to shrink in the direction of width due to the tension acting thereon, resulting in longitudinal wrinkles. Therefore, it is desirable to dispose the rotating roller close to the belt conveyor, so that the nonwoven fabric is pulled off at a position as near to the rotating roller as possible. Preferably the distance between the belt and the axis of the roller is 30 cm or less, more preferably 20 cm or less.

It is also desirable to expand the nonwoven fabric, after it has been peeled from the belt conveyor, in the direction of width with a width expanding device before winding the nonwoven fabric into a roll. As described previously, the nonwoven fabric that is fed via the rotating roller has shrunk in the direction of width under the tension applied thereto. In the expanding process described above, the nonwoven fabric is preferably expanded back to its original width. Since the nonwoven fabric is shrunk in the longitudinal direction in this process, the tension acting on the nonwoven fabric can be further mitigated by the expansion process, thus making it possible to form the nonwoven fabric roll with a further reduction in the tightness of winding.

In the expansion process, it is preferable to expand the nonwoven fabric gradually in the direction of width by sequentially performing a series of expansion processing steps. This embodiment makes it possible to reduce the tension more properly. Moreover, since routing the nonwoven fabric through a plurality of width expanding devices allows the filaments sufficient time to naturally cool down and solidify before the nonwoven fabric is wound into the roll, the self-adhesive properties of the nonwoven fabric roll can be further reduced. In order to cool down the filaments more efficiently and reduce the adhesive properties of the nonwoven fabric roll even further, cool air from a blower may be applied to the nonwoven fabric that has been peeled formed the belt conveyor or, in embodiments where the expanding device has a roller that makes contact with and expands the nonwoven fabric, a coolant may be circulated through the roller thereby cooling down the nonwoven fabric via the roller.

The term "tube" as used in the present disclosure refers to any cylindrical object around which the nonwoven fabric is wound, and is normally a paper tube or a resin tube. The present invention is more useful on nonwoven fabrics that have basis weight less than about 400 g/m$^2$ and most useful on nonwoven fabrics of basis weight less than about 300 g/m$^2$. When the basis weight is greater than 400 g/m$^2$, the nonwoven fabric has sufficient tensile strength and thickness to recover its dimensions in the take-up process. As a result such nonwoven fabrics do not necessarily become too tight when wound into a roll. The present invention is particularly useful when the width of the nonwoven fabric is 40 cm or greater. It becomes increasingly more difficult to pull the nonwoven fabric off the conveyor net uniformly as the width increases.

Specific embodiments of the present invention will be described below with reference to the accompanying drawings. FIG. 1 is a schematic diagram showing the configuration of a nonwoven fabric roll production apparatus according to one embodiment. As shown in the drawing, the nonwoven fabric roll production apparatus 1 of this embodiment has partly the same configuration as the nonwoven fabric roll production apparatus 100 of the prior art shown in FIG. 9. Accordingly, identical components will be denoted with the same reference numerals and description thereof will be omitted.

As shown in FIG. 1, the nonwoven fabric roll production apparatus of this embodiment comprises a rotating roller 2 disposed above the transportation zone of a belt conveyor 115, and expanding rollers 3, 4 and feed rollers 5, 6 disposed successively between the rotating roller 2 and a take-up device 125.

The rotating roller 2 is a roller that preferably has a circular cross section, and is disposed above the transportation zone of the belt conveyor 115, to serve the function of peeling the nonwoven fabric 131 from the belt conveyor 115, as described previously. For this purpose, the circumference of the rotating roller 2 is preferably finished very smoothly to improve close contact with the nonwoven fabric 131. Specifically, the surface finish of the roller 2 is preferably 2S or lower in the surface roughness grade specified in JIS B 0601, more preferably 1.5S or lower, and most preferably 1.0S or lower. The cross section described above is not limited to circular shape and may be oval or polygonal.

The width expanding rollers 3 and 4 consist of spiral ridges 3*a*, 4*a* on the circumference of rollers having circular cross section. The ridges 3*a*, 4*a* are formed in opposite spiraling directions from the center of the roller out to the ends. Thus the width expanding rollers 3, 4 rotate in the directions indicated by arrows, to expand the nonwoven fabric 131 that is in pressure contact with the circumferential surface thereof in the direction of width by the actions of the ridges 3*a*, 4*a*.

Figure 3:
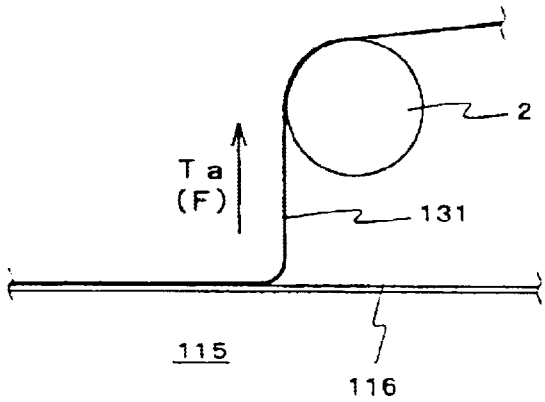
FIG. 3 is a view showing the action of a rotating roller of this embodiment.

In the nonwoven fabric roll production apparatus of this embodiment having the configuration described above, the thermoplastic elastomer nonwoven fabric 131 spun by the spinning device 1 and formed into a sheet on the belt conveyor 115 is carried by the belt conveyor 115, and is peeled from the belt conveyor 115 to be guided upward to the rotating roller 2 disposed above the transportation zone, as shown in FIG. 3. As mentioned previously, the nonwoven fabric 131 adheres to the belt conveyor 115 due to the adhesive property of the thermoplastic elastomer. In this embodiment, since the nonwoven fabric 131 is peeled from the belt conveyor 115 by the lifting action of the rotating roller 2, a tension substantially the same as the tension Ta acting on the nonwoven fabric 131 serves as the peeling force F as shown in FIG. 3. Thus it is possible to peel off the nonwoven fabric 131, from the belt conveyor 115 by applying the minimum necessary tension on the nonwoven fabric 131, minimizing the elastic deformation and the longitudinal wrinkles that are generated in the nonwoven fabric 131 during the peeling off process.

Also because the nip rollers 120 as shown in FIG. 9 are not used for peeling off the nonwoven fabric 131 in this embodiment, any longitudinal wrinkles generated in the nonwoven fabric 131 due to the tensile force of peeling off are not fixed in the fabric by the pressure of nip rollers.

As the distance between the position where the nonwoven fabric 131 is peeled from the belt conveyor 115 and the position where the rotating roller 2 is located becomes larger, the nonwoven fabric 131 becomes more likely to shrink in the direction of width due to the tension acting thereon, resulting in longitudinal wrinkles. Therefore, it is desirable to dispose the rotating roller 2 as near to the belt conveyor 115 as possible.

The nonwoven fabric 131 that has been peeled from the belt conveyor 115 passes the width expanding rollers 3, 4 and the tension adjust rollers 5, 6 and is wound up by the take-up device 125 around the tube 132 to make the nonwoven fabric roll 130. The nonwoven fabric 131 that is fed via the rotating roller 2 has shrunk in the direction of width under the tension applied thereto. The width expanding rollers 3, 4 act to expand the nonwoven fabric 131 in the direction of width and thereby shrink the nonwoven fabric 131 in the longitudinal direction. Consequently, the tension acting on the nonwoven fabric 131 can be countered by the expansion process, thus making it possible to form the nonwoven fabric roll 130 that has been wound up through the tension adjust rollers 5, 6 with less tightness of winding.

In another embodiment, the nonwoven fabric 131 can be expanded gradually in the direction of width when the expansion process comprises two or more processing steps using expanding rollers such as 3, 4, thus making it possible to reduce the tension more properly. Moreover, since routing the nonwoven fabric 131 through the width expanding rollers allows the filaments sufficient time to naturally cool down and solidify before the nonwoven fabric 131 is wound into the roll, self-adhesive properties of the fabric in the nonwoven fabric roll 130 can be mitigated. In order to cool down the filaments more efficiently and mitigate the adhesive properties of the nonwoven fabric roll 130 further, cool air from a blower may be applied to the nonwoven fabric 131 that has been peeled from the belt conveyor 115, or a coolant such as cold water may be circulated through the width expanding rollers 3, 4 thereby cooling down the nonwoven fabric 131 via the expanding rollers 3, 4.

The nonwoven fabric roll 130 produced by the nonwoven fabric roll production apparatus 1 of the invention is wound less tightly then prior art rolls. Thus despite the self-adhesive properties of the thermoplastic elastomer, a nonwoven fabric roll that can be easily unrolled with a unrolling tension of 0.25 g/cm/basis-weight or less can be formed.

Figure 4:
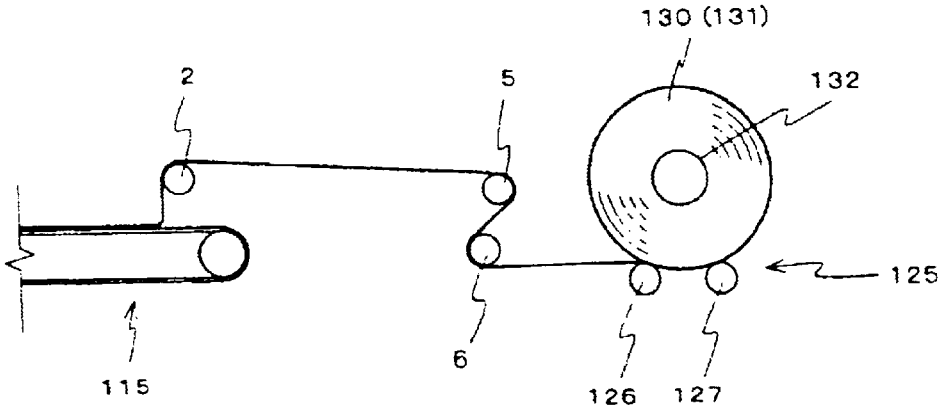
FIG. 4 is a front view schematically showing the constitution of a thermoplastic elastomer nonwoven fabric roll production apparatus according to another embodiment of the present invention.
Figure 5:
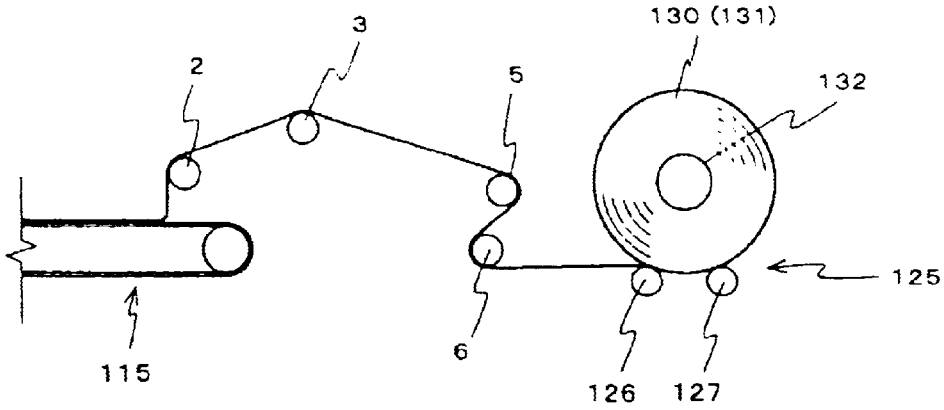
FIG. 5 is a front view schematically showing the constitution of a thermoplastic elastomer nonwoven fabric roll production apparatus according to yet another embodiment of the present invention.
Figure 6:
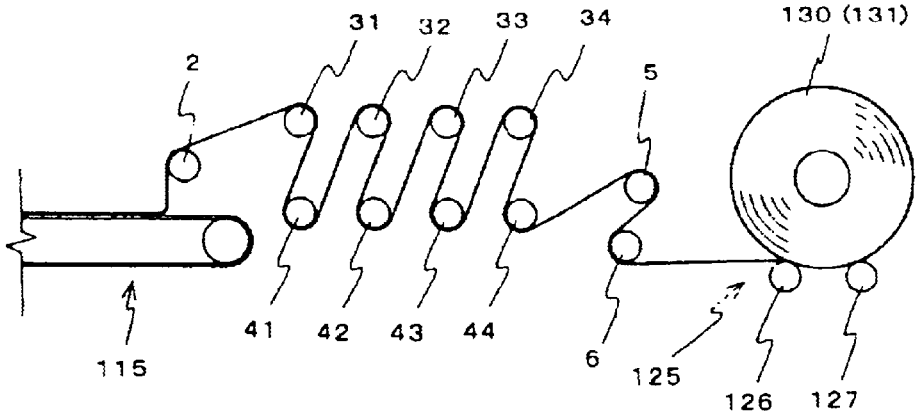
FIG. 6 is a front view schematically showing the constitution of a thermoplastic elastomer nonwoven fabric roll production apparatus according to another embodiment of the present invention.

According alternative embodiments, as long as a nonwoven fabric roll 130 with an unrolling tension of 0.25 g/cm/basis-weight or less can be formed, such a configuration as shown in FIG. 5 where only one width expanding roller 3 is provided may be employed, and a configuration as shown in FIG. 4 where the expanding rollers 3, 4 are removed altogether may also be employed. A configuration as shown in FIG. 6 where a larger number of width expanding rollers are provided may also be employed. In FIG. 6, four pairs of width expanding rollers 31, 41, 32, 42, 33, 43, 34, 44 are provided. Although the width expanding rollers 3, 4 exemplified in FIG. 4 have ridges 3*a*, 4*a* on the circumference thereof, the rollers are not limited to this structure as long as the width expanding function is provided For example, the ridges 3*a*, 4*a* may be replaced with spiral undulations or grooves formed in the circumference or, alternatively, a fundamentally different structure may be employed.

EXAMPLES

The present invention will now be described in more detail below by way of examples.

Example 1 a) Raw Material

A thermoplastic polyurethane polymer having Shore A scale hardness of 90, obtained by polymerizing three components, i.e. diol (having a molecular weight of 2000) comprising butanediol, hexanediol and adipic acid as a soft segment, 4,4'-diphenylmethane diisocyanate (MDI) and 1,4-butanediol according to a batch polymerization system, was used as a raw material. This polymer contains a phenolic antioxidant and a benzotriazole light screening agent, each in the amount of 0.2 weight %. The melt viscosity of the polymer measured at 190 degrees centigrade by using a flow tester was 12000 poise.

b) Production Apparatus

An apparatus was used to produce the nonwoven fabric roll 130 which comprised the spinning device 101 and the belt conveyor 115 disposed as shown in FIG. 1, and the rotating rollers 2, the feed rollers 5, 6 and the take-up device 125 disposed as shown in FIG. 4. For the melt extruder 110, one having L/D ratio of 25 and diameter of 50 cm was used. A coat hanger type melt blow head 102 was used that was 1380 mm in length (along the width of the belt conveyor 115 ), 270 mm in width (the longitudinal direction of the belt conveyor 115 ) and had 625 nozzles each having opening 0.4 mm in diameter, disposed linearly at 2 mm intervals on the bottom surface thereof. The belt conveyor 115 comprised a conveyor belt 116 made of plain-woven metal mesh of mesh size 40. Disposed below the conveyor belt 116 at a position right below the melt blow head 102 is a suction device for drawing off the gas discharged from the discharge port 102*c*.

c. Production Method

The thermoplastic polyurethane polymer obtained as described above was dried in vacuum using a rotary vacuum drier and was supplied to the melt extruder 110 to be melted therein, with the molten thermoplastic polyurethane polymer being guided to the melt blow head 102 to be spun. Melting temperature in the melt extruder 110 was set to 220 degrees centigrade. Spinning conditions in the melt blow head 102 were set to 230 degrees centigrade for the temperature of the melt blow head 102, 0.64 g/hole/min for the discharge rate of the thermoplastic polyurethane polymer from the nozzles 102*b*, 235 degrees centigrade for the temperature of gas discharged from the discharge port 102*c* with the flow rate thereof being set to 12000 NL/min.

Thermoplastic polyurethane filaments thus spun were piled up into a sheet on the belt conveyor 115 to form the nonwoven fabric 131. The nonwoven fabric 131 was peeled from the belt conveyor 115 by the rotating roller 2, passed through the feed rollers 5, 6 and was wound up by the take-up device 125 around a paper tube measuring 8.5 cm in diameter thereby forming the nonwoven fabric roll 130. A sample of nonwoven fabric measuring 500 m in length was wound into the nonwoven fabric roll 130. Running speed of the belt conveyor 115 was set to 4.88 m/min, peripheral speed of the rotating roller 2 was set to 5.03 m/min, and the peripheral speed of the feed rollers 5, 6 and the take-up rollers 126, 127 was set to 5.00 m/min.

Example 2

The nonwoven fabric roll 130 of Example 2 was obtained in the same manner as in Example 1, except the production apparatus had the width expanding roller 3 disposed between the rotating roller 2 and the feed roller 5 as shown in FIG. 5 and the peripheral speed of the feed rollers 5, 6 and the take-up rollers 126, 127 was set to 4.92 m/min. A width expanding roller 3 with spiral grooves formed on the outer circumference thereof was used and was rotated at a peripheral speed of 5.03 m/min.

Example3

The nonwoven fabric roll 130 of Example 3 was obtained in the same manner as in Example 1, except the production apparatus had the width expanding rollers 3, 4 disposed between the rotating roller 2 and the feed roller 5 as shown in FIG. 1, and the peripheral speed of the feed rollers 5, 6 and the take-up rollers 126, 127 was set to 4.88 m/min. Width expanding rollers 3, 4 with spiral grooves formed on the outer circumference thereof were used and were rotated at a peripheral speed of 5.03 m/min.

Example 4

The nonwoven fabric roll 130 of Example 4 was obtained in the same manner as in Example 1, except the production apparatus had the width expanding rollers 31, 41, 32, 42, 33, 43, 34, 44 disposed between the rotating roller 2 and the feed roller 5 as shown in FIG. 6, and the peripheral speed of the feed rollers 5, 6 and the take-up rollers 126, 127 was set to 4.88 m/min. Width expanding rollers 31, 41, 32, 42, 33, 43, 34, 44 with spiral grooves formed on the outer circumference thereof were used. The peripheral speed of the width expanding rollers 31, 41 was set to 5.03 m/min, and the peripheral speed of the width expanding rollers 32, 42, 33, 43, 34, 44 was set to 4.90 m/min.

(Comparative Example 1 )

The nonwoven fabric roll 130 of Comparative Example 1 was obtained in the same manner as in Example 1, except that a prior art production apparatus shown in FIG. 9 was used and that the peripheral speed of the take-up rollers 126, 127 was set to 5.12 m/min Peripheral speed of the rollers 121, 122 was set to 5.27 m/min.

The nonwoven fabric rolls of Examples 1 to 4 and Comparative Example 1 produced as described above were measured for basis weight (g/m$^2$ ), width of roll (cm), outer diameter (cm), roll weight (g), density of roll (g/cc) and unrolling tension T (g/cm/basis-weight), with the results of measurements shown in Table 1. The basis weight (g/m$^2$ ) was determined by measuring the weight of a sample of size 25 cm×25 cm that was punched from the nonwoven fabric and multiplying the weight by a factor of 16. The roll weight was determined by subtracting the weight of the paper tube from the total weight. Density of roll (g/cc) was determined by calculating the total volume of the roll including the paper tube, subtracting the volume of the paper tube from the total volume to obtain the volume of the nonwoven fabric (roll volume), and dividing the roll weight by the roll volume.

Figure 7:
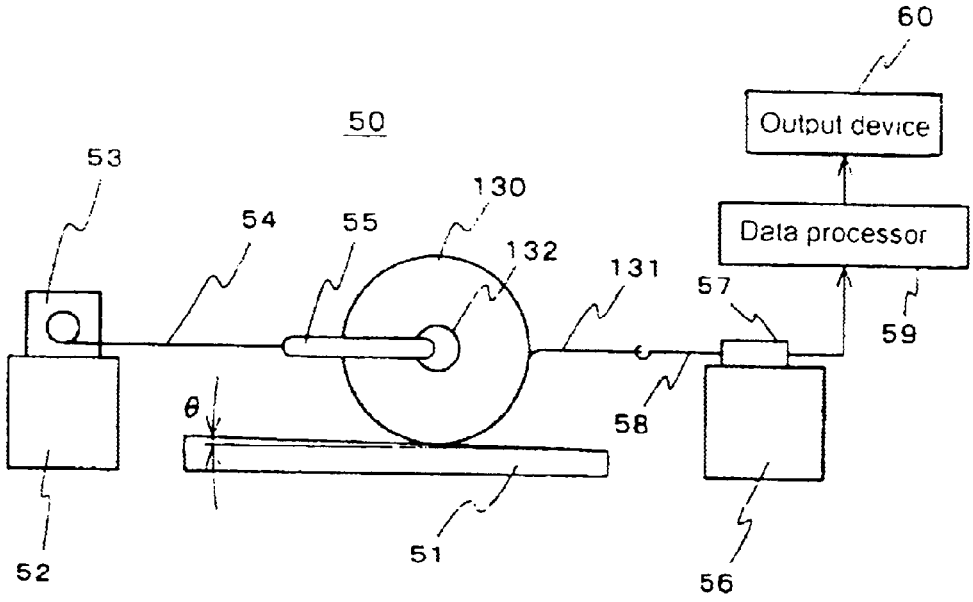
FIG. 7 is a schematic view showing the constitution of a measuring instrument for measuring the unrolling tension.

The unrolling tension T was measured with a tension measuring instrument 50 as shown in FIG. 7. The tension measuring instrument 50 comprises a stage 51 to place the nonwoven fabric roll 130 thereon, an engaging member 55 consisting of a shaft with a bearing mounted thereon to be inserted into the paper tube 132 of the nonwoven fabric roll 130 and a member that has a shape of rectangular C in plan view and is connected to both ends of the shaft, a constant speed take-up device 53 that winds up, at a constant speed, a wire 54 that is fastened to the engaging member 55 at one end thereof, a U gauge (tension meter) 57 having a hook 58 that is hooked on one end of the nonwoven fabric 131 at the lead of the nonwoven fabric roll 130, a data processor 59 that processes data obtained by the U gauge (tension meter) 57 and an output device 60 that outputs data processed by the data processor 59. When the wire 54 is wound up at constant speed by the constant speed take-up device 53, the nonwoven fabric roll 130 moves toward the constant speed take-up device 53 while rolling, thereby causing a tension in the nonwoven fabric 131 on the leading edge, with the tension being measured by the U gauge 57. When the tension exceeds the adhesion of the nonwoven fabric roll 130, the nonwoven fabric 131 is unrolled from the nonwoven fabric roll 130.

The top surface of the stage 51 is inclined by about 5 degrees from the horizontal plane in order to stabilize the rolling speed of the nonwoven fabric roll 130. A portion of the nonwoven fabric 131 where the hook 58 is hooked on is reinforced by attaching a reinforcing tape. Winding speed of the constant speed take-up device 53 was set in a range from 3 to 4 m/min.

Figure 8:
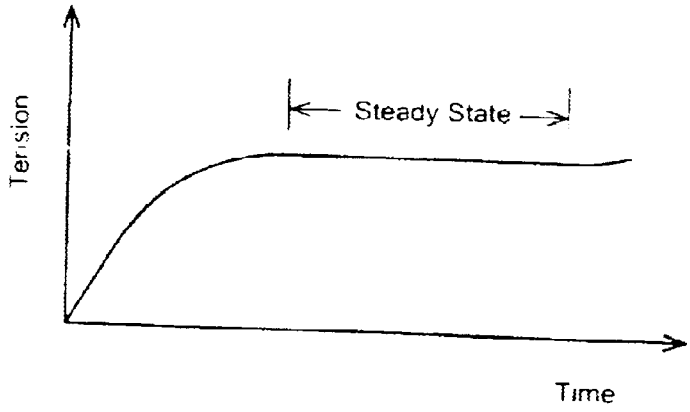
FIG. 8 is a graph showing the change in tension with time as measured by the measuring instrument.

The tension acting on the nonwoven fabric 131 when unrolled, measured as described above, changes as shown in FIG. 8. In this example, moving average of the tension in the steady state region in FIG. 8 was taken to calculate the mean value t (g), that was divided by the product width 1 (cm) and the basis weight W (g/m$^2$ ) thereby determining the tension T according to the equation:

$$T=(t/1)/W$$

As shown in Table 1, longitudinal wrinkles were not generated in any of the nonwoven fabric rolls 130 of Examples 1 to 4, while the nonwoven fabric roll of Comparative Example 1 showed longitudinal wrinkles located 10 to 20 cm inward from both edges thereof and shrunk in the width. It is also shown that the nonwoven fabric rolls 130 of Examples 1 to 4 have lower densities indicating lower tightness of winding than the nonwoven fabric roll of Comparative Example 1. The nonwoven fabric rolls 130 of Examples 1 to 4 also showed lower unrolling tension indicating that the self-adhesive properties of the fabric were lower than in the nonwoven fabric roll of Comparative Example 1.

TABLE 1

| | Basis Weight (g/m$^2$) | Roll Width (cm) | Outer Diameter (cm) | Roll Weight (g) | Density of Roll (g/cc) | Unrolling Tension (g/m/basis-weight) | Wrinkle Generated |
|---|---|---|---|---|---|---|---|
| Example 1 | 64.9 | 123 | 38.5 | 39,900 | 0.283 | 0.24 | No |
| Example 2 | 65.0 | 125 | 39.5 | 40,600 | 0.271 | 0.19 | No |
| Example 3 | 65.0 | 126 | 40.9 | 41,000 | 0.258 | 0.10 | No |

TABLE 1-continued

| | Basis Weight ($g/m^2$) | Roll Width (cm) | Outer Diameter (cm) | Roll Weight (g) | Density of Roll (g/cc) | Unrolling Tension (g/m/basis-weight) | Wrinkle Generated |
|---|---|---|---|---|---|---|---|
| Example 4 | 65.2 | 126 | 41.4 | 41,100 | 0.255 | 0.06 | No |
| Comp. Example 1 | 64.8 | 120 | 35.4 | 38,900 | 0.318 | 0.35 | Yes |

In Examples 1 to 4, the nonwoven fabric 131 could be peeled off the belt conveyor 115 under stable conditions by setting the peripheral speed of the rotating roller 2 to be 2 to 4% higher than the running speed of the belt conveyor 115, while the nonwoven fabric 131 of Comparative Example 1 showed poor release at the center thereof, and could be peeled off only y setting the peripheral speed of the nip rollers 120 (rollers 121, 122 ) 8% higher than the running speed of the belt conveyor 115.

First aid bandages were produced by using the nonwoven fabric rolls of Examples 1 to 4 and Comparative Example 1, as described below. The nonwoven fabric was drawn out in the horizontal direction at a speed of 13 m/min from the nonwoven fabric roll supported rotatably, and 40 $g/m^2$ of an acrylic adhesive (copolymer of 87 weight % of 2 -ethylhexylacrylate, 10 weight % of vinyl acetate and 3 weight % of acrylic acid) was coated on one side thereof with release paper being laminated on the adhesive layer, thereby forming an adhesive sheet. The adhesive sheet was punched to make rectangular pieces measuring 19 mm in the longitudinal direction and 72 mm in the direction of the nonwoven fabric. A gauze pad measuring 13×22 mm was placed on the adhesive layer with the adhesive layer covered by a lining to make the first aid bandage.

The first aid bandages of Examples 1 to 4 and Comparative Example 1 made as described above were left to stand for three months. Then dimensions of the nonwoven fabric portion were measured with the result shown in Table 2.

TABLE 2

| | Dimensions Immediately After Production (mm) | Dimensions 3 Months After Production (mm) | Shrinkage Ratio In Longitudinal Direction of Nonwoven Fabric (%) |
|---|---|---|---|
| Product of Example 1 | 19.0 × 72.0 | 18.7 × 72.0 | 1.6 |
| Product of Example 2 | 19.0 × 72.0 | 18.9 × 72.0 | 0.5 |
| Product of Example 3 | 19.0 × 72.0 | 19.0 × 72.0 | 0 |
| Product of Example 4 | 19.0 × 72.0 | 19.0 × 72.0 | 0 |
| Product of comparative Example 1 | 19.0 × 72.0 | 17.0 × 72.0 | 10.5 |

As shown in Table 2, the first aid bandage of Comparative Example 1 showed greater shrinkage ratio after three months than any of the first aid bandages of Examples 1 to 4. This it thought to be because the high adhesive properties of the nonwoven fabric roll of Comparative Example 1 requires a greater unrolling tension that causes the nonwoven fabric to stretch more when unrolled, resulting in greater shrinkage after delayed restoration from the stretched state. In order to minimize the shrinkage ratio, the unrolling tension is preferably 0.2 g/cm/basis-weight or lower.

Example 5

The nonwoven fabric roll 130 of Example 5 was made by using thermoplastic polyurethane polymer having Shore A hardness of 82 made from polytetramethylene glycol having a molecular weight of 1000, MDI, and 1, 4-butandiol as the raw material. The temperature of the melt blow head 102 was set to 225 degrees centigrade, the temperature of gas discharged from the discharge port 102*c* was set to 230 degrees centigrade and the flow rate thereof was set to 11000 NL/min. Running speed of the belt conveyor 115 and the peripheral speed of the feed rollers 5, 6 and the take-up rollers 126, 127 were set to 4.23 m/min Peripheral speeds of the rotating roller 2 and the expanding rollers 3, 4 that are similar to Example 3 were set to 4.35 m/min. The thermoplastic polyurethane includes 0.2 weight % of phenolic antioxidant, 0.2 weight % of benzotriazole light screening agent and 0.3 weight % of montan wax having adhesion mitigating action for urethane.

Comparative Example 2

The nonwoven fabric roll 130 of Comparative Example 2 was obtained in the same manner as in Example 5, except using the production apparatus shown in FIG. 9. The peripheral speed of the take-up rollers 126, 127 was set to 5.12 m/min. Peripheral speed of the rollers 121, 122 was set to 5.27 m/min.

The nonwoven fabric rolls of Example 5 and Comparative Example 2 produced as described above were measured as described previously for basis weight ($g/m^2$), width of roll (cm), outer diameter (cm), roll weight (g), density of roll (g/cc) and unrolling tension T (g/cm/basis-weight), with the results of measurements shown in Table 3.

TABLE 3

| | Basis Weight ($g/m^2$) | Roll Width (cm) | Outer Diameter (cm) | Roll Weight (g) | Density of Roll (g/cc) | Unrolling Tension (g/m/basis-weight) | Wrinkle Generated |
|---|---|---|---|---|---|---|---|
| Example 5 | 75.0 | 126 | 44.2 | 47,300 | 0.254 | 0.11 | No |
| Comp. Example 2 | 74.9 | 115 | 37.6 | 44,900 | 0.355 | 0.36 | Yes |

As shown in Table 3, longitudinal wrinkles were not generated in the nonwoven fabric roll of Example 5, while the nonwoven fabric roll of Comparative Example 2 showed longitudinal wrinkles and had shrunk in width. It is also shown that the nonwoven fabric rolls of Example 5 has less roll density indicating lower tightness of winding than the nonwoven fabric roll of Comparative Example 2. The nonwoven fabric roll of Example 5 also showed lower unrolling tension indicating less adhesive properties than the nonwoven fabric roll of Comparative Example 2.

Although not shown in the tale, in Example 5, the nonwoven fabric 131 could be peeled from the belt conveyor 115 under stable conditions by setting the peripheral speed of the rotating roller 2 to be 2 to 4% higher than the running speed of the belt conveyor 115, while the nonwoven fabric 131 of Comparative Example 2 showed poor release at the center thereof, and could be peeled off only by setting the peripheral speed of the nip rollers 120 (rollers 121, 122) 8% higher than the running speed of the belt conveyor 115.

The nonwoven fabric rolls of Example 5 and Comparative Example 2 and urethane films (50 microns) laminated onto release paper were used to make a 2-layer product, for use as dust-free gloves used in semiconductor device factories. Specifically, 5 $g/m^2$ of a polyurethane-based hot melt adhesive was applied by spraying uniformly over the polyurethane film on the release paper. The nonwoven fabric unrolled formed the nonwoven fabric roll was laminated on the adhesive surface of the polyurethane film, with the two layers adhered to each other by pressing with nip rollers, and wound up into a roll. The polyurethane film was made to a width of 130 cm, and the winding speed was set to 15 m/min. Results of measuring the width of the nonwoven fabrics laminated on the polyurethane films produced as described above are shown in Table 4.

TABLE 4

| | Width of Nonwoven fabric roll (cm) | Width of Nonwoven Fabric On Film (mm) | Shrinkage Ratio (%) |
|---|---|---|---|
| Product of Example 5 | 126 | 125.5 | 0.4 |
| Product of Comparative Example 2 | 115 | 110 | 4.3 |

As shown in Table 4, Comparative Example 2 produced a product that has width (110 cm) smaller than the width of the nonwoven fabric roll before laminating the two layers (115 cm), while products having substantially the same width as the original width were obtained in Example 5. This is thought to be because a greater unrolling tension was applied due to the higher adhesive properties of Comparative Example 2, resulting in greater stretch when unrolling.

We claim:

1. A thermoplastic elastomer nonwoven fabric roll made by a process comprising piling and bonding thermoplastic elastomer filaments onto a belt conveyor so as to form a sheet of nonwoven fabric, peeling the sheet of nonwoven fabric thus formed from the belt conveyor with a roller, passing the peeled sheet of nonwoven fabric through tension adjust rolls, and winding the sheet of nonwoven fabric around a tube thereby forming a nonwoven fabric roll, characterized in that the tension required to unroll the nonwoven fabric from the nonwoven fabric roll is 0.25 g/cm/basis-weight or less.

* * * * *